US007828471B2

(12) United States Patent
Lin

(10) Patent No.: US 7,828,471 B2
(45) Date of Patent: Nov. 9, 2010

(54) LAMP ASSEMBLY

(75) Inventor: I-Thun Lin, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 90 days.

(21) Appl. No.: 12/346,818

(22) Filed: Dec. 30, 2008

(65) Prior Publication Data

US 2009/0310351 A1 Dec. 17, 2009

(30) Foreign Application Priority Data

Jun. 11, 2008 (CN) ..... 2008 1 0302104

(51) Int. Cl.
*F21V 7/04* (2006.01)

(52) U.S. Cl. ..... 362/555; 362/26; 362/260

(58) Field of Classification Search ..... 362/26, 362/27, 216, 217.01, 217.05, 217.07, 554, 362/555, 615, 623, 624, 628
See application file for complete search history.

(56) References Cited

U.S. PATENT DOCUMENTS 6,860,628 B2 * 3/2005 Robertson et al. ..... 362/555
6,910,783 B2 * 6/2005 Mezei et al. ..... 362/615
2009/0161359 A1 * 6/2009 Siemiet et al. ..... 362/260

* cited by examiner

*Primary Examiner*—Y My Quach Lee
(74) *Attorney, Agent, or Firm*—Clifford O. Chi

(57) ABSTRACT

An exemplary lamp assembly includes a light guide member, a light reflective member and a light source. The light guide member includes a light-emitting surface, a concave surface opposite to the light-emitting surface, and a light incident surface connected between the light emitting surface and the concave surface. The light reflective member includes a reflective surface opposite to the concave surface of the light guide member. The light source is arranged adjacent to the light incident surface of the light guide member. The light source includes a circuit board, a plurality of light emitting diodes, and two contact pins. The light emitting diodes are electrically mounted on the circuit board and face toward the light incident surface. The contact pins are electrically connected to the circuit board and extend in a direction away from the light incident surface for electrical connection to a power source.

14 Claims, 5 Drawing Sheets

LAMP ASSEMBLY

BACKGROUND

1. Technical Field

The present invention relates to lamp assemblies, and particularly to a lamp assembly with LED light sources.

2. Discussion of Related Art

In recent years, light emitting diodes (LEDs) have been widely used in consumer and commercial applications, due to their low cost, long life, durability, and low power consumption. Fluorescent lamps have been gradually replaced by LED lamp assemblies.

However, the replacement rate is not as fast as expected. Because LED light assemblies are different with the fluorescent lamps in the structure, and more importantly, the cost of a LED lamp is higher than a fluorescent lamp. In addition, the LED lamp assemblies usually use a plurality of LEDs to reach the coordinative brightness comparing with the fluorescent lamps. For example, the LED lamp assembly to replace a 20 W fluorescent lamp will need at least sixteen LEDs in an array. Therefore, the cost of the LED lamp assembly may be expensive which may affect the replacement rate of the LED lamp assemblies.

Therefore, what is needed is a lamp assembly with LED light sources capable of overcoming the described limitations.

BRIEF DESCRIPTION OF THE DRAWINGS

Many aspects of the present lamp assembly can be better understood with reference to the following drawings. The components in the drawings are not necessarily to scale, the emphasis instead being placed upon clearly illustrating the principles of the present lamp assembly. Moreover, in the drawings, like reference numerals designate corresponding parts throughout the several views.

DETAILED DESCRIPTION OF EMBODIMENTS

Reference will now be made to the drawings to describe in detail of the exemplary embodiments of the lamp assembly.

Figure 1:
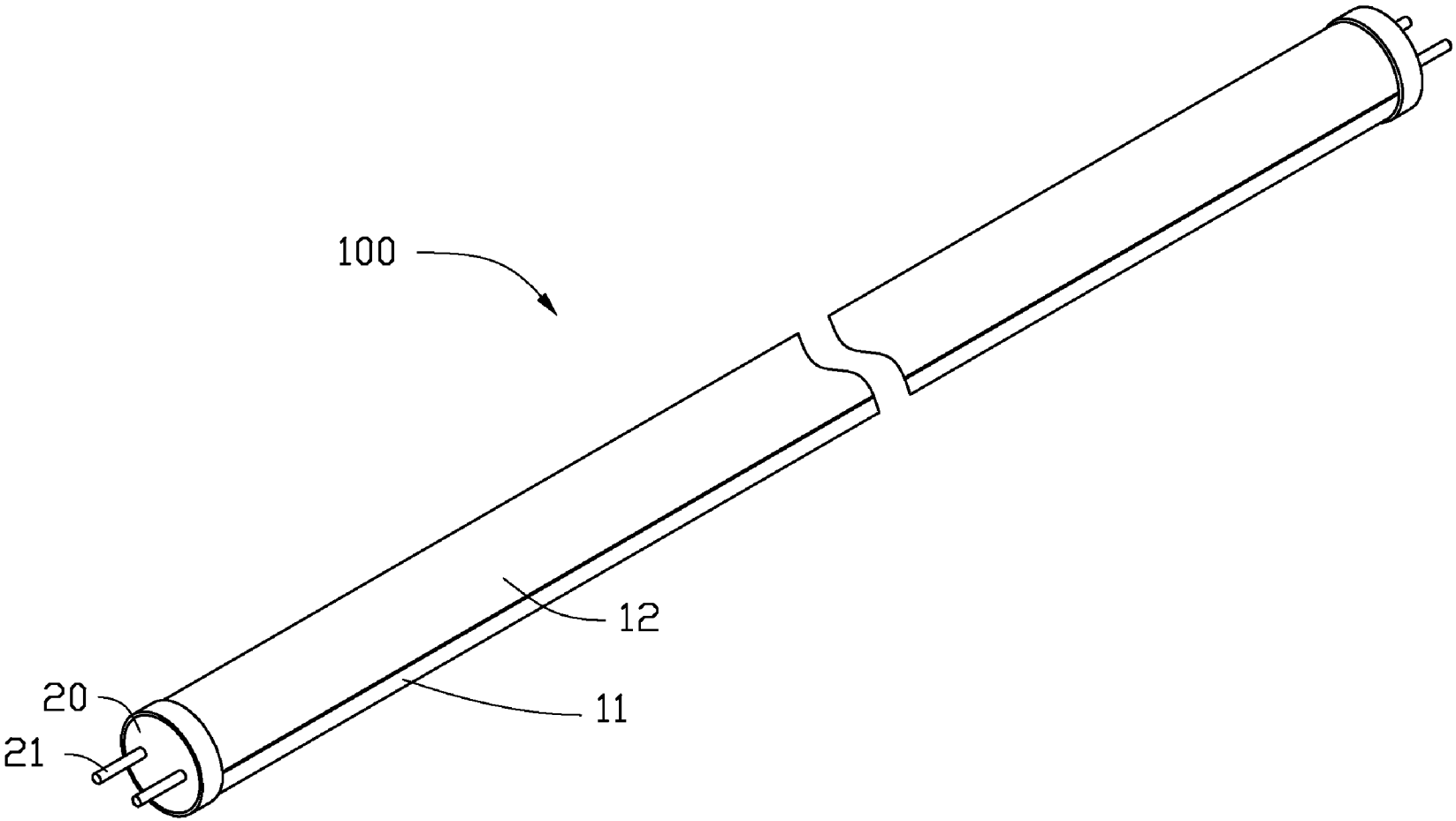
FIG. 1 is a schematic, isometric view of a lamp assembly in accordance with an exemplary embodiment.
Figure 2:
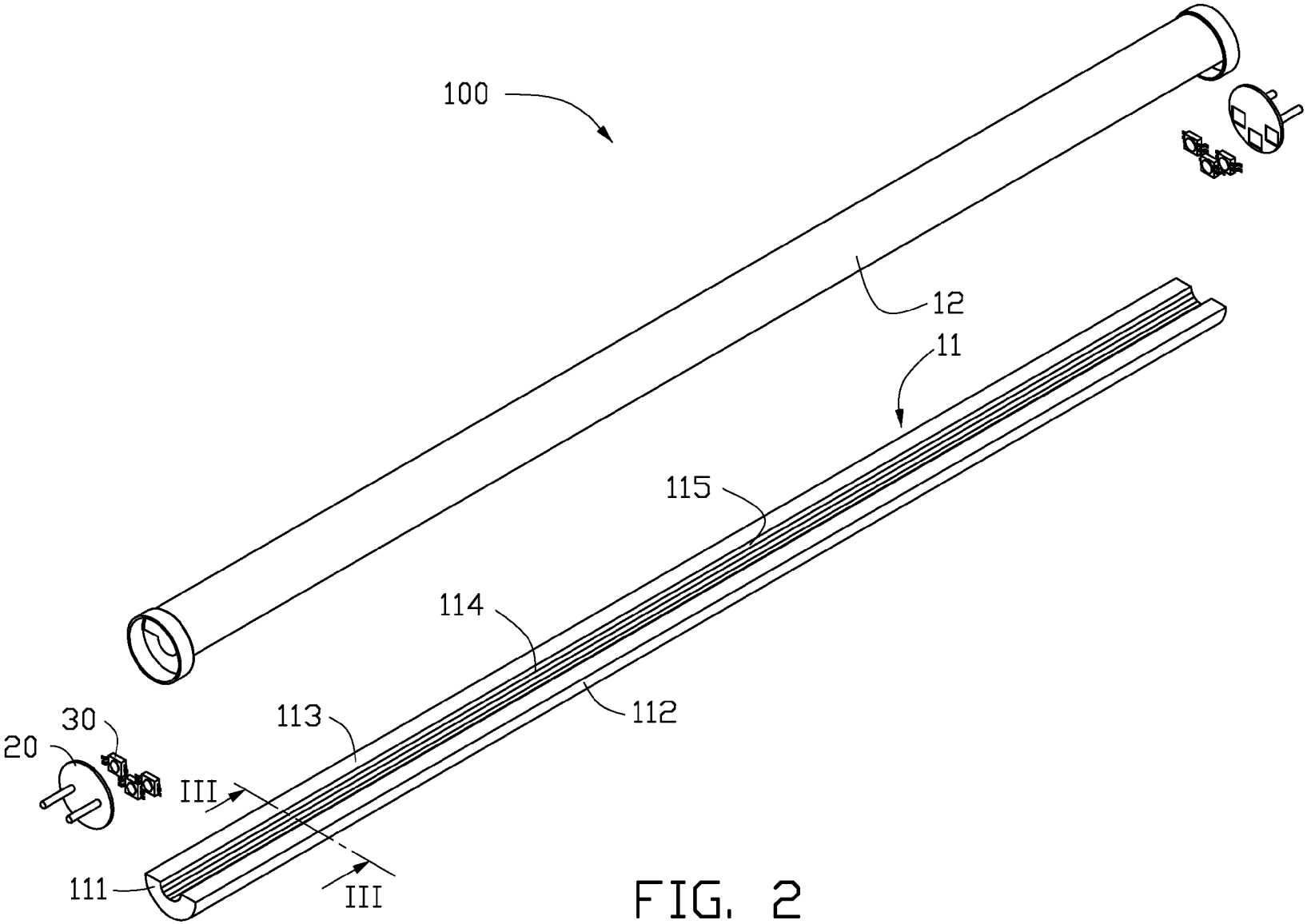
FIG. 2 is a schematic, exploded view of the lamp assembly of FIG. 1.
Figure 3:
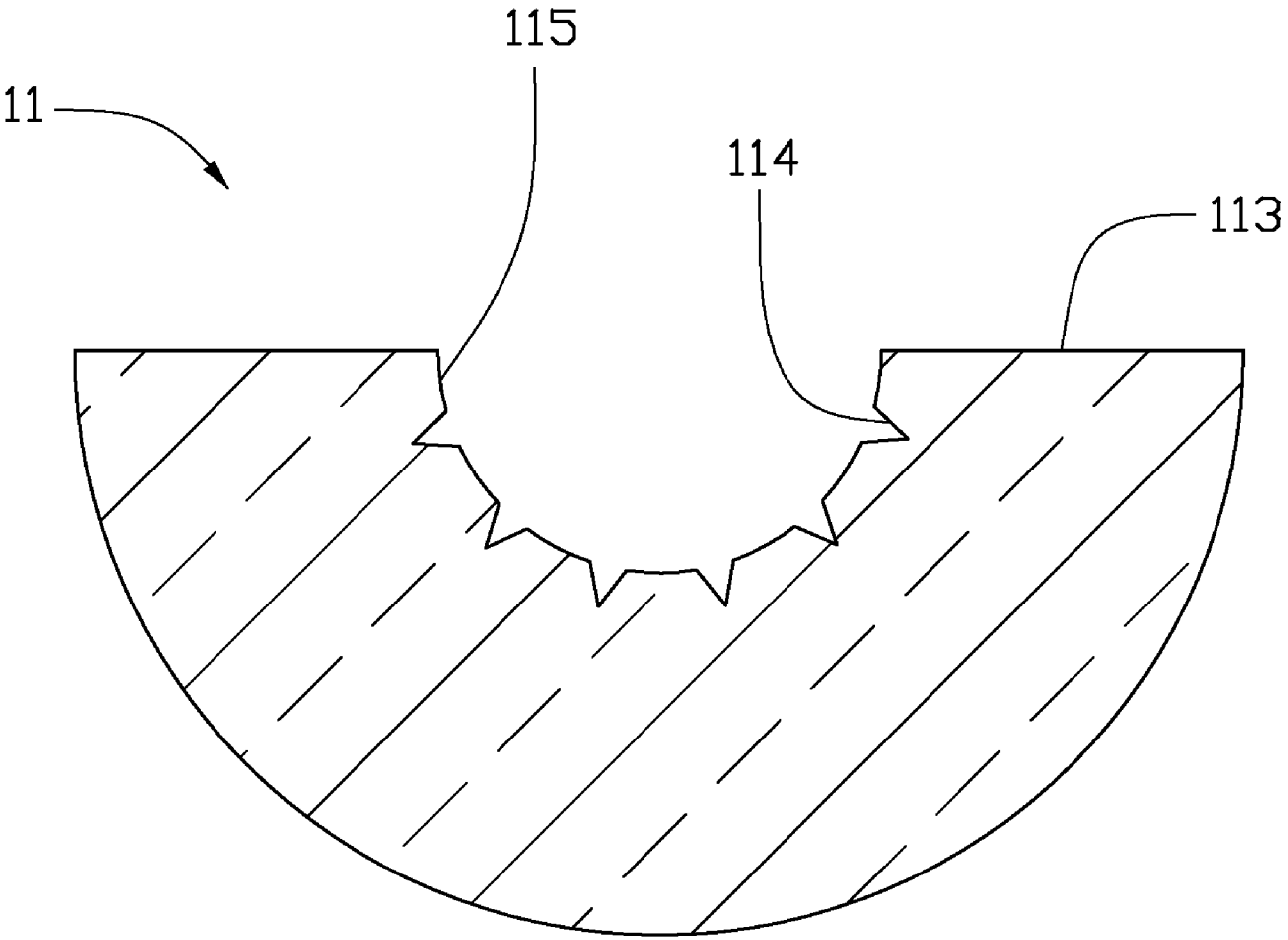
FIG. 3 is a schematic, cross-sectional view of a light guide member of the lamp assembly of FIG. 1.

Referring to FIGS. 1 to 3, a lamp assembly 100, in accordance with an exemplary embodiment, includes a light guide member 11, a light reflective member 12 arranged opposite to the light guide member 11, and a light source 30 arranged adjacent to the light guide member 11.

Figure 4:
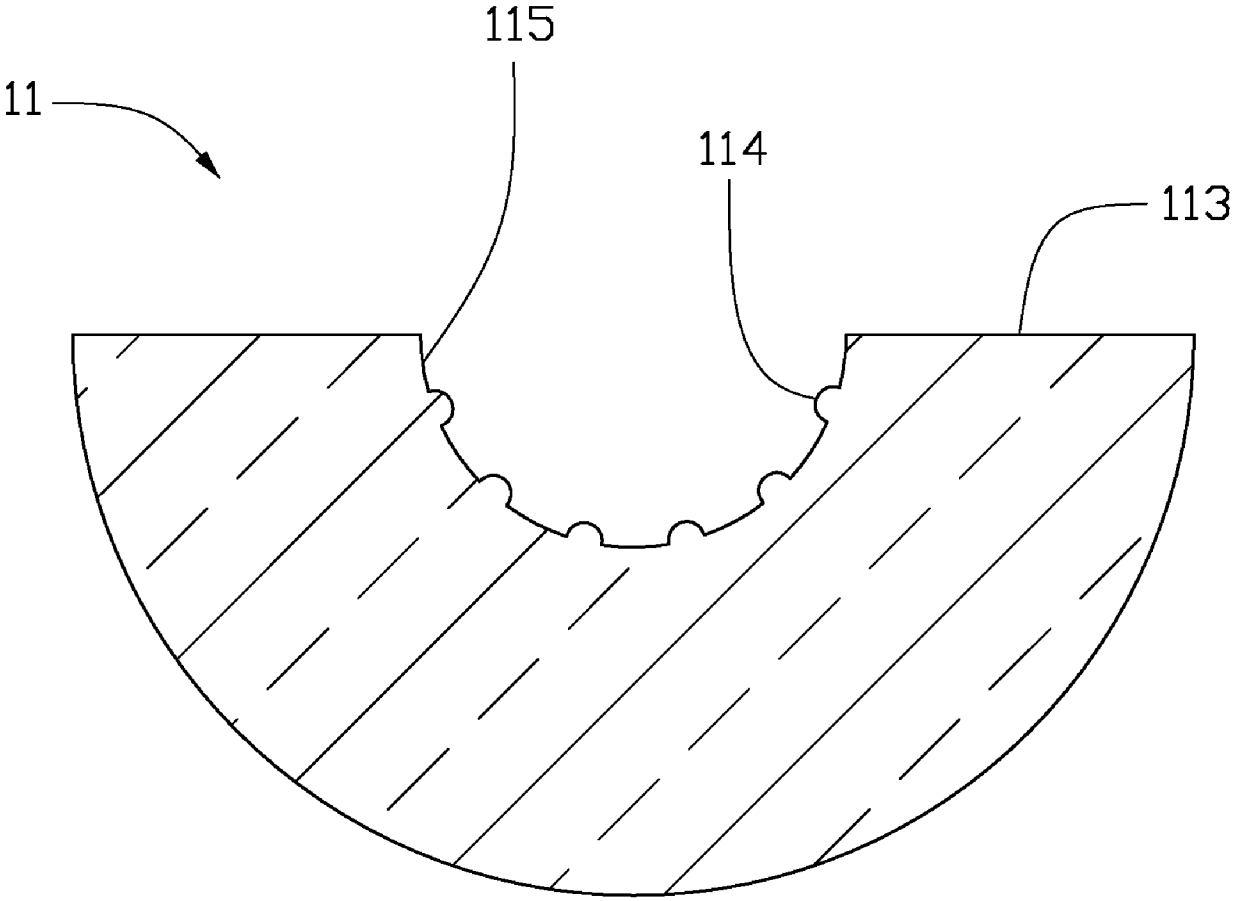
FIG. 4 is a schematic, cross-sectional view of a light guide member of the lamp assembly of FIG. 1.
Figure 5:
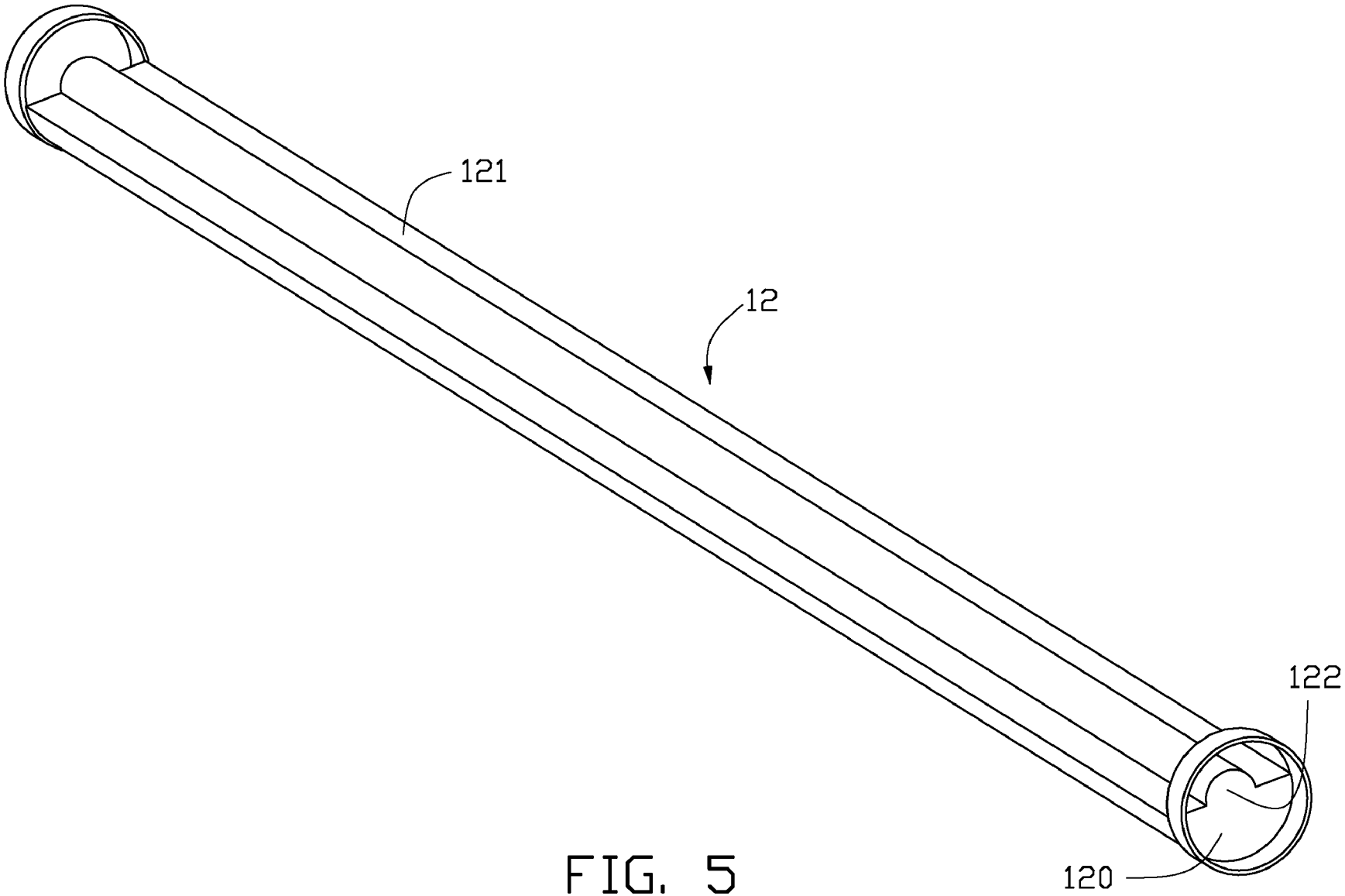
FIG. 5 is a schematic, isometric view of the light reflective member of the lamp assembly of FIG. 1.

The light guide member 11 includes a light incident surface 111, a light-emitting surface 112 adjacent to the light incident surface 111 and a concave surface 113 opposite to the light-emitting surface 112. The light guide member 11 is configured for guiding the light beams emitted from the light source 30 and converting the light source into surface light source, then exiting from the light-emitting surface 112. The light guide member 11 is a semi-cylinder. The concave surface 113 defines a groove 115 at the center of the light guide member 11. The groove 115 extends along a lengthwise direction of the light guide member 11. The shape of the cross-section of the groove 115 is semicircular. The light guide member 11 may be made of polymethyl methacrylate (PMMA), polycarbonate (PC) or glass, etc. The light sources 30 is arranged opposite to the light incident surface 111 of the light guide member 11. In the present embodiment, the light guide member 11 includes two light incident surfaces 111 arranged on two ends of the light guide member 11. The light sources 30 includes six light emitting diodes averagely divided into two groups and are respectively arranged opposite to two ends of the light guide member 11. A plurality of light scattering structures 114 is evenly arranged on the inner surface of the groove 115 to improve the uniformity of the surface light beams of the light guide member 11. The light scattering structures 114 may be a plurality of parallel V-shaped grooves extending along a lengthwise direction of the light guide member 11 (see FIG. 3) or a plurality of scattering dots (see FIG. 4)distributing on the concave surface 113.

The light reflective member 12 includes a semi-cylindrical main body 120, a reflective surface 121 opposite to the bottom surface 113 of the light guide member 11 and a protrusion 122 arranged on the center of the main body 120 protruding from the main body 120. The protrusion 122 extends in a lengthwise direction of the light reflective member 12 and is engaged in the groove 115 in the concave surface 113. The protrusion 122 is a semi-cylinder. The shape of the protrusion 122 is cooperated with the groove 115. Thus, the light guide member 11 is combined with the light reflective member 12 forming a cylinder. Furthermore, the reflective surface 121 of the light reflective member 12 is covered by a reflective film (not shown) to let the light beams from the bottom surface 113 of the light guide member 11 reflect to the light guide member 11, then emit from the light-emitting surface 112. Thus, the lightness of the lamp assembly 100 can be improved.

The light source 30 further includes two circuit boards 20 and two contact pins 21. The two circuit boards 20 are separately arranged on two ends of the light reflective member 12. Each circuit board 20 has three light emitting diodes electrically mounted on the inner side surface of the circuit board 20 and facing toward the light incident surface 111 of the light guide member 11. The three light emitting diodes are arranged in triangle distribution on the circuit board 20.

The contact pins 21 are electrically connected to the circuit boards 20 and extending in a direction away from the light incident surface 111 for electrically connection to a power source. Thus, the lamp assembly 100 is capable of directly replacing a fluorescent lamp in nowadays.

It should be understood that the total number of the circuit board 20 can be only one and is arranged on one end of the light reflective member 12. The light emitting diodes can be arranged only on one circuit board 20 facing toward the light incident surface 111 of the light guide member 11. The number of the light emitting diodes can be only one or more than one.

It should be understood that the shape of the light guide member 11 and the shape the light reflective member 12 are not limited as the present embodiment. For example, the light guide member 11 and the light reflective member 12 can be a semi truncated cone, a cuboid, a triangular prism or other shapes. What is required is that the reflective surface 121 of the light reflective member 12 and the bottom surface 113 of the light guide member 11 are opposite to each other, and light beams emitted from the bottom surface 113 can be reflected by the reflective surface 121.

The lamp assembly 100 of the present embodiment only use a few light emitting diodes to achieve the same brightness of the current lamp assembly that using LED as light sources.

Therefore, the cost of the production can be reduced. Moreover, the specification of the lamp assembly 100 is as same as the specification of the present fluorescent lamp, such as size, shape and the plugs, so the lamp assembly 100 is capable of replacing the fluorescent lamp directly.

While the present invention has been described as having preferred or exemplary embodiments, the embodiments can be further modified within the spirit and scope of this disclosure. This application is therefore intended to cover any variations, uses, or adaptations of the embodiments using the general principles of the invention as claimed. Further, this application is intended to cover such departures from the present disclosure as come within known or customary practice in the art to which the invention pertains and which fall within the limits of the appended claims or equivalents thereof.

What is claimed is:

1. A lamp assembly comprising:

a light guide member comprising a light-emitting surface, a concave surface opposite to the light-emitting surface, a light incident surface connected between the light emitting surface and the concave surface, a groove defined in the concave surface, the groove extending along a lengthwise direction of the light guide member, and a plurality of light scattering structures arranged on the concave surface;

a light reflective member comprising a reflective surface opposite to the concave surface of the light guide member, wherein the light reflective member comprises a protrusion protruding from the reflective surface, the protrusion extending in a lengthwise direction of the light reflective member and engaged in the groove in the concave surface; and a light source arranged adjacent to the light incident surface of the light guide member, the light source comprising a circuit board, a plurality of light emitting diodes, and two contact pins, the light emitting diodes electrically mounted on the circuit board and facing toward the light incident surface, the contact pins electrically connected to the circuit board and extending in a direction away from the light incident surface for electrical connection to a power source.

2. The lamp assembly of claim 1, wherein the light guide member and the light reflective member cooperatively form a cylinder.

3. The lamp assembly of claim 1, wherein the shape of the cross-section of the groove is semi-circular.

4. The lamp assembly of claim 1, wherein the shape of the protrusion is semi-cylindrical.

5. The lamp assembly of claim 1, wherein the light scattering structures comprise a plurality of parallel V-shaped grooves extending along a lengthwise direction of the light guide member.

6. The lamp assembly of claim 1, wherein the light scattering structures comprise a plurality of scattering dots.

7. A lamp assembly comprising:

a light guide member comprising a light-emitting surface, a concave surface opposite to the light-emitting surface, and two light incident surfaces connected between the light emitting surface and the concave surface and located at opposite sides of the light guide member;

a light reflective member comprising a reflective surface opposite to the concave surface of the light guide member, the light reflective member and the light guide member cooperatively forming a substantially cylindrical body;

two light source modules mounted at opposite ends of the substantially cylindrical body, each light source module comprising a circuit board, a plurality of light emitting diodes, and two contact pins, the light emitting diodes electrically mounted on the circuit board and facing toward the corresponding light incident surface, the contact pins electrically connected to the circuit board and extending in a direction away from the light incident surface for electrical connection to a power source; and a groove defined in the concave surface of the light guide member, wherein the groove extending along a lengthwise direction of the light guide member;

wherein the light reflective member further comprises a protrusion protruding from the reflective surface, the protrusion extending in a lengthwise direction of the light reflective member and engaged in the groove in the concave surface.

8. The lamp assembly of claim 7, wherein the length of the light reflective member is greater than that of the light guide member.

9. The lamp assembly of claim 7, wherein the shape of the cross-section of the groove is semi-cylinder.

10. The lamp assembly of claim 7, wherein the shape of the protrusion is semi-cylindrical.

11. The lamp assembly of claim 7, wherein the light guide member is substantially a semi-cylinder, and the light reflective member is substantially a semi-cylinder.

12. The lamp assembly of claim 7, further comprising a plurality of light scattering structures arranged on the concave surface of the light guide member.

13. The lamp assembly of claim 12, wherein the light scattering structures comprise a plurality of parallel V-shaped grooves extending along a lengthwise direction of the light guide member.

14. The lamp assembly of claim 12, wherein the light scattering structures comprise a plurality of scattering dots.

* * * * *